US011300328B2

(12) United States Patent
Perevozchikov et al.

(10) Patent No.: US 11,300,328 B2
(45) Date of Patent: Apr. 12, 2022

(54) OIL CONTROL FOR CLIMATE-CONTROL SYSTEM

(71) Applicant: Emerson Climate Technologies, Inc., Sidney, OH (US)

(72) Inventors: Michael M. Perevozchikov, Tipp City, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 140 days.

(21) Appl. No.: 16/719,491

(22) Filed: Dec. 18, 2019

(65) Prior Publication Data

US 2020/0200181 A1 Jun. 25, 2020

Related U.S. Application Data

(60) Provisional application No. 62/782,014, filed on Dec. 19, 2018.

(51) Int. Cl.
*F25B 1/10* (2006.01)
*F25B 49/02* (2006.01)
(Continued)

(52) U.S. Cl.
CPC ..... *F25B 1/10* (2013.01); *F04B 23/04* (2013.01); *F04B 39/023* (2013.01);
(Continued)

(58) Field of Classification Search
CPC ..... F25B 1/10; F25B 13/00; F25B 49/022; F25B 2400/0401; F25B 2400/13;
(Continued)

(56) References Cited

U.S. PATENT DOCUMENTS 3,719,057 A * 3/1973 Grant ..... F25B 1/10 62/193
4,938,029 A * 7/1990 Shaw ..... F25B 40/02 62/117
(Continued)

FOREIGN PATENT DOCUMENTS

EP 2487437 A1 8/2012
JP 2002357367 A 12/2002
(Continued)

OTHER PUBLICATIONS

International Search Report & Written Opinion regarding Application No. PCT/US2019/067652 dated Apr. 21, 2020.
(Continued)

*Primary Examiner* — Peter J Bertheaud
(74) *Attorney, Agent, or Firm* — Harness, Dickey & Pierce, P.L.C.

(57) ABSTRACT

Systems and methods for providing lubricant from a first compressor to a second compressor are provided. A control module receives a start command for a climate-control system having the first and second compressors, allows lubricant from the first compressor to flow into an inlet of the second compressor, turns the second compressor to an ON-mode, and prevents lubricant from the first compressor from flowing into the inlet of the second compressor after the second compressor has been in the ON-mode for a predetermined time period.

20 Claims, 6 Drawing Sheets

(51) Int. Cl.

| | |
|---|---|
| ***F04B 39/02*** | (2006.01) |
| ***F04D 25/16*** | (2006.01) |
| ***F04D 27/00*** | (2006.01) |
| ***F04D 29/063*** | (2006.01) |
| ***F25B 13/00*** | (2006.01) |
| ***F04C 28/02*** | (2006.01) |
| ***F04C 29/02*** | (2006.01) |
| ***F04C 18/02*** | (2006.01) |
| ***F04C 23/00*** | (2006.01) |
| ***F04B 41/06*** | (2006.01) |
| ***F04B 23/04*** | (2006.01) |

(52) U.S. Cl.
CPC ..... *F04B 39/0207* (2013.01); *F04B 41/06* (2013.01); *F04C 18/023* (2013.01); *F04C 18/0215* (2013.01); *F04C 23/008* (2013.01); *F04C 28/02* (2013.01); *F04C 29/02* (2013.01); *F04C 29/028* (2013.01); *F04D 25/16* (2013.01); *F04D 27/00* (2013.01); *F04D 29/063* (2013.01); *F25B 13/00* (2013.01); *F25B 49/022* (2013.01); *F04C 2270/24* (2013.01); *F25B 2400/0401* (2013.01); *F25B 2400/13* (2013.01)

(58) Field of Classification Search
CPC .... F25B 9/008; F25B 2600/0261; F25B 5/02; F25B 31/004; F25B 41/20; F25B 43/02; F25B 49/02; F04B 23/04; F04B 39/0207; F04B 39/023; F04B 41/06; F04B 49/02; F04B 53/18; F04B 49/065; F04C 18/0215; F04C 18/023; F04C 23/008; F04C 28/02; F04C 29/02; F04C 29/028; F04C 2270/24; F04C 2210/261; F04C 23/001; F04C 28/065; F04C 28/24; F04C 29/021
See application file for complete search history.

(56) References Cited

U.S. PATENT DOCUMENTS

| | | | | |
|---|---|---|---|---|
| 5,157,933 | A * | 10/1992 | Brendel | F25B 41/20 62/196.4 |
| 6,082,132 | A | 7/2000 | Numoto et al. | |
| 8,408,024 | B2 * | 4/2013 | Ogata | F04B 39/0207 62/402 |
| 10,337,766 | B2 | 7/2019 | Takizawa | |
| 2007/0245768 | A1 | 10/2007 | Sakae et al. | |
| 2008/0282728 | A1 | 11/2008 | Takegami et al. | |
| 2008/0283133 | A1 | 11/2008 | Shaw | |
| 2017/0284706 | A1 | 10/2017 | Ozu et al. | |
| 2018/0066656 | A1 | 3/2018 | Perevozchikov et al. | |
| 2018/0209696 | A1 | 7/2018 | Takizawa | |

FOREIGN PATENT DOCUMENTS

| | | | |
|---|---|---|---|
| JP | 2007093017 | A | 4/2007 |
| JP | 2010025446 | A | 2/2010 |
| JP | 6390796 | B2 | 9/2018 |

OTHER PUBLICATIONS

International Search Report regarding Application No. PCT/US2019/067645 dated Sep. 4, 2020.
Written Opinion of the ISA regarding Application No. PCT/US2019/067645 dated Sep. 4, 2020.

* cited by examiner

OIL CONTROL FOR CLIMATE-CONTROL SYSTEM

CROSS-REFERENCE TO RELATED APPLICATIONS

This application claims the benefit of U.S. Provisional Application No. 62/782,014, filed on Dec. 19, 2018. The entire disclosure of the above application is incorporated herein by reference.

FIELD

The present disclosure relates to oil control for a climate-control system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices, and one or more compressors circulating a working fluid (e.g., refrigerant or carbon dioxide) through the fluid circuit. Efficient and reliable operation of the climate-control system is desirable to ensure that the climate-control system is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a method including receiving a start command for a climate-control system having first and second compressors; allowing lubricant from the first compressor to flow into an inlet of the second compressor; turning the second compressor to an ON-mode; and preventing lubricant from the first compressor from flowing into the inlet of the second compressor after the second compressor has been in the ON-mode for a predetermined time period. The second compressor is configured to provide compressed working fluid to an inlet of the first compressor. The second compressor is a sumpless compressor.

In some configurations, the first compressor is in an OFF-mode. Lubricant flows from an oil sump of the first compressor to the inlet of the second compressor.

In some configurations, the climate control system includes a lubricant passageway in fluid communication with the oil sump of the first compressor and the inlet of the second compressor. The lubricant flows from the oil sump of the first compressor to the inlet of the second compressor via the lubricant passageway.

In some configurations, the first compressor is turned to an ON-mode in response to receiving the start command. Lubricant is entrained in compressed working fluid that is discharged from an outlet of the first compressor to the inlet of the second compressor.

In some configurations, the climate control system includes a bypass passageway in fluid communication with the outlet of the first compressor and the inlet of the second compressor. Compressed working fluid having lubricant entrained therein flows from the outlet of the first compressor to the inlet of the second compressor via the bypass passageway.

In some configurations, the predetermined time period is between 1 second and 30 seconds.

In some configurations, the second compressor is a horizontal sumpless compressor.

In another form, the present disclosure provides a method that includes receiving a start command for a climate-control system having first and second compressors; allowing lubricant to flow from a first region of the first compressor into an inlet of the second compressor; turning the second compressor to an ON-mode; preventing lubricant from the first region of the first compressor from flowing into the inlet of the second compressor after the second compressor has been in the ON-mode for a predetermined time period; and allowing lubricant to flow from a second region of the first compressor into the inlet of the second compressor. The second compressor configured to provide compressed working fluid to an inlet of the first compressor. The second compressor is a sumpless compressor. The second region of the first compressor is different from the first region and is at a high pressure than the first region.

In some configurations, lubricant is allowed to flow from the second region of the first compressor into the inlet of the second compressor after lubricant is prevented from flowing from the first region of the first compressor into the inlet of the second compressor.

In some configurations, the first region is an oil sump of the first compressor and the second region is a discharge chamber of the first compressor.

In some configurations, the first compressor is in an OFF-mode. Lubricant flows from the oil sump of the first compressor to the inlet of the second compressor via a lubricant passageway that is in fluid communication with the oil sump and the inlet of the first compressor.

In some configurations, the first compressor is turned to an ON-mode in response to receiving the start command. Lubricant in the discharge chamber is entrained in compressed working fluid that is discharged from the discharge chamber and flowing to the inlet of the second compressor.

In some configurations, the climate control system includes a bypass passageway in fluid communication with the discharge chamber of the first compressor and the inlet of the second compressor. Compressed working fluid having lubricant entrained therein flows from the discharge chamber of the first compressor to the inlet of the second compressor via the bypass passageway.

In some configurations, the second compressor is a horizontal sumpless compressor.

In some configurations, the predetermined time period is between 1 second and 30 seconds.

In yet another form, the present disclosure provides a method that includes receiving a start command for a climate-control system having first and second compressors; allowing lubricant from an oil separator to flow into an inlet of the second compressor; turning the second compressor to an ON-mode; and preventing lubricant from the oil separator from flowing into the inlet of the second compressor after the second compressor has been in the ON-mode for a predetermined time period. The second compressor configured to provide compressed working fluid to an inlet of the first compressor. The second compressor is a sumpless compressor.

In some configurations, the oil separator is disposed along a discharge line of the first compressor.

In some configurations, the climate control system includes a first lubricant passageway in fluid communication with the oil separator and the inlet of the second compressor. The lubricant flows from the oil separator to the inlet of the second compressor via the first lubricant passageway.

In some configurations, the climate-control system allows lubricant from the oil separator to flow into the inlet of the first compressor via a second lubricant passageway.

In some configurations, the predetermined time period is between 1 second and 10 seconds.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
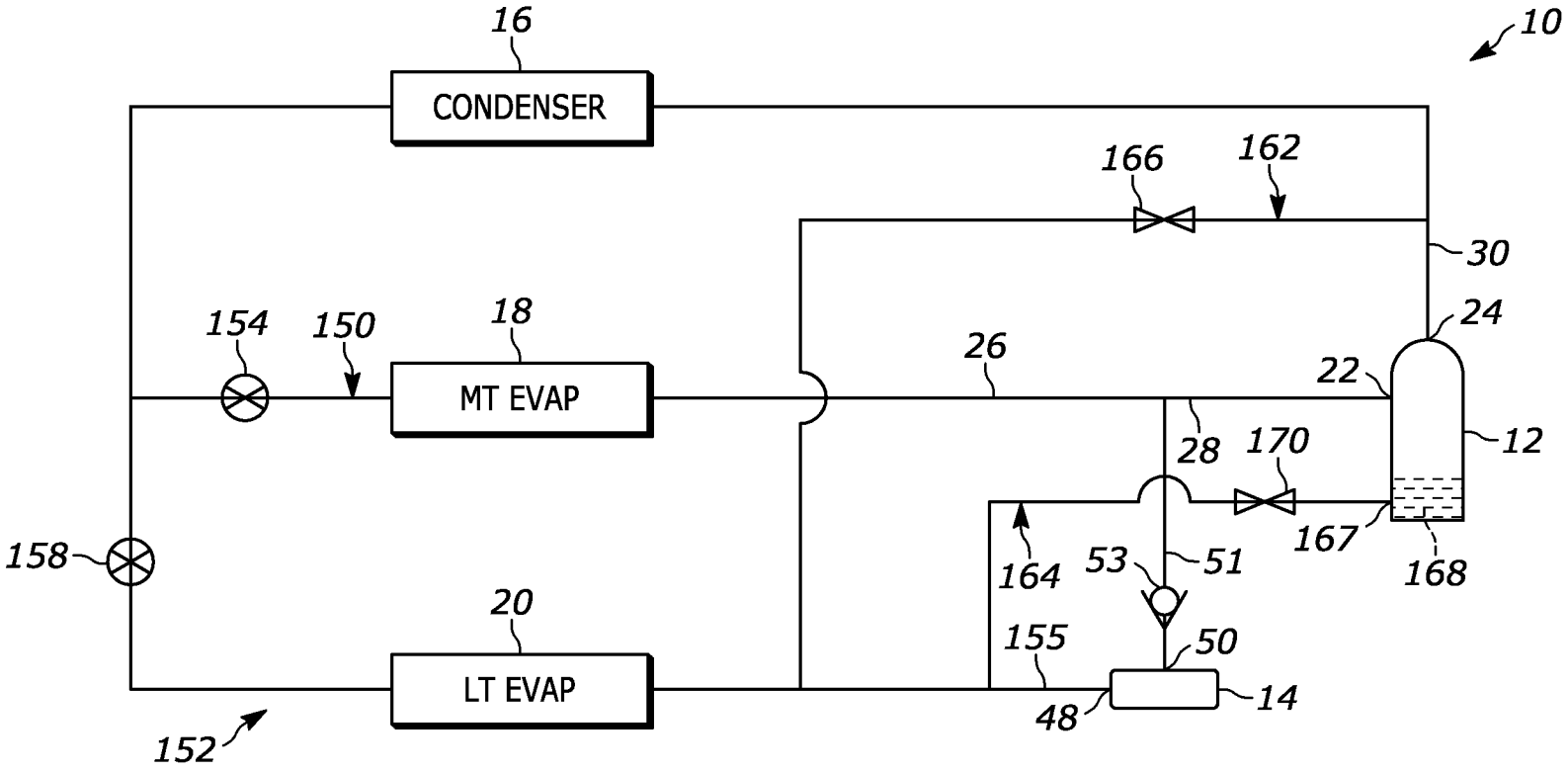
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 3:
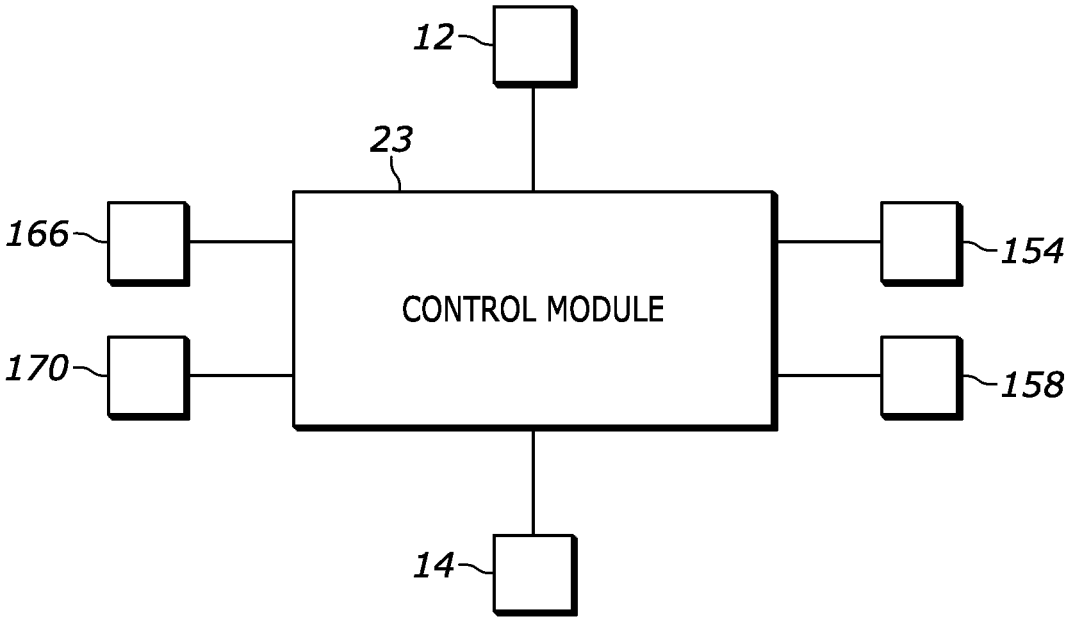
FIG. 3 is a block diagram illustrating communication between a control module and components of the climate-control system of FIG. 1.

With reference to FIGS. 1 and 3, a climate-control system 10 is provided that may include a fluid-circuit having one or more first compressors 12, one or more second compressors 14, a first heat exchanger 16 (an outdoor heat exchanger such as a condenser or gas cooler, for example), a second heat exchanger 18 (an indoor heat exchanger such as a medium-temperature evaporator, for example), a third heat exchanger 20 (an indoor heat exchanger such as a low-temperature evaporator, for example), and a control module 23 (FIG. 3). The one or more first compressors 12 and/or the one or more second compressors 14 may pump working fluid (e.g., refrigerant, carbon dioxide, etc.) through the circuit.

Each first compressor 12 may be a low-side compressor (i.e., a compressor in which the motor assembly is disposed within a suction-pressure chamber within the shell), for example, and may be any suitable type of compressor such as a scroll, rotary, reciprocating or screw compressor, for example. Each first compressor 12 may have an inlet 22 (e.g., a first inlet fitting) and a first outlet 24 (e.g., an outlet fitting). The inlet 22 may provide fluid to a compression mechanism (not shown). A first fluid passageway 26 may extend from the second heat exchanger 18 to the inlet 22 of first compressor 12 via suction line 28. In this manner, working fluid exiting the second heat exchanger 18 may flow into each first compressor 12 to be compressed by the compression mechanism of the first compressor 12. After the working fluid is compressed by the compression mechanism of the first compressor 12, the working fluid can be discharged from the first compressor 12 through the first outlet 24 to a discharge line 30.

In some configurations, the first compressor 12 could be a high-side compressor (i.e., a compressor in which the motor assembly is disposed within a discharge-pressure chamber within the shell). In some configurations, the first compressor 12 may have different capacities than one another or than the one or more second compressors 14. In some configurations, one or more of the first compressors 12 and/or one or more of the second compressors 14 may include a fixed-speed, variable-speed motor. In some configurations, one or more of the first compressors 12 and/or one or more of the second compressors 14 may be other modulation types such as a pulse-width-modulation scroll compressor configured for scroll separation (e.g., a digital scroll compressor).

Figure 2:
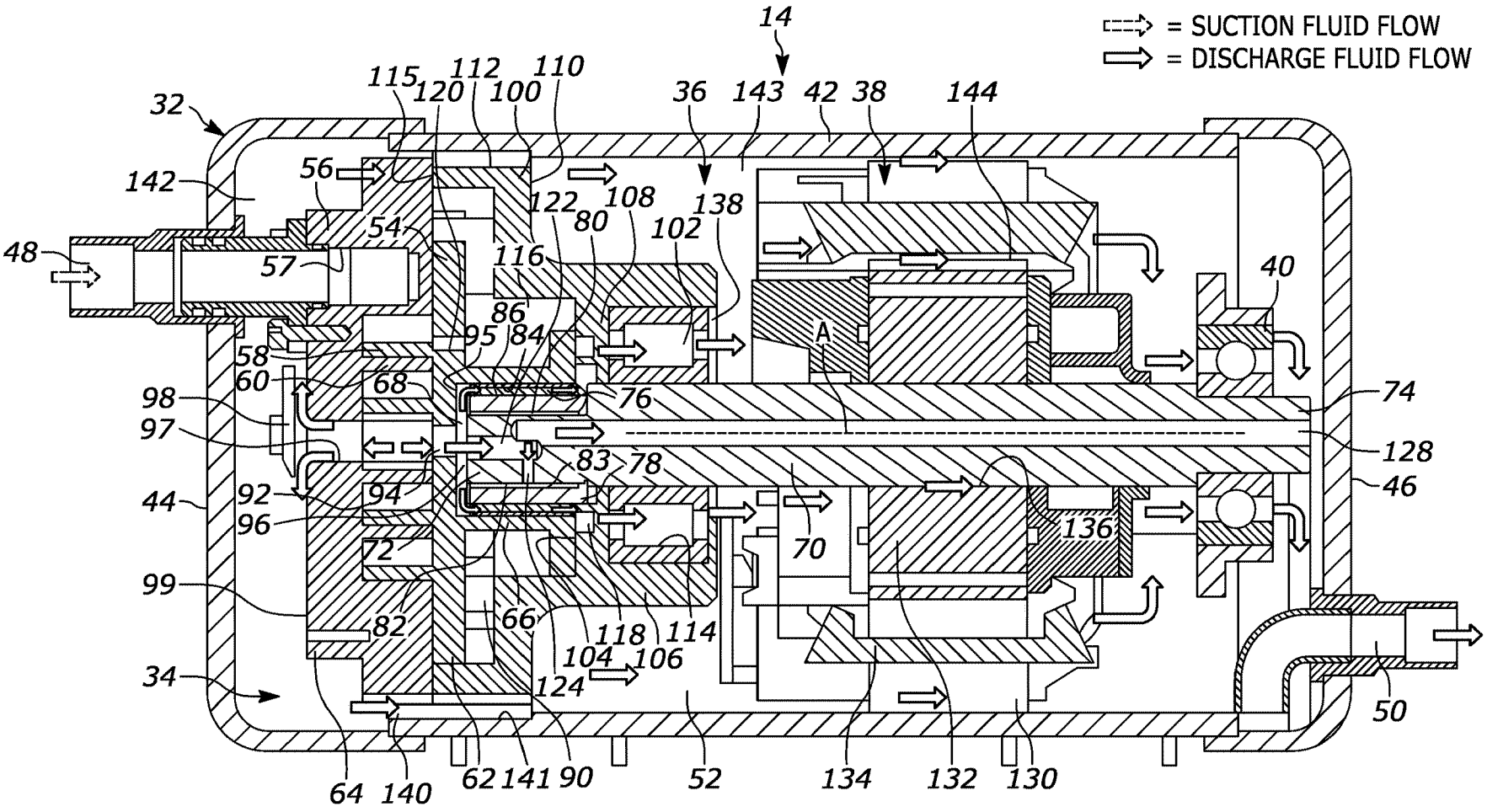
FIG. 2 is a cross-sectional view of a compressor of FIG. 1.

With reference to FIGS. 1 and 2, the second compressor 14 may be a horizontal compressor and may be adjacent to the third heat exchanger 20. The second compressor 14 may include a cylindrical shell 32, a compression mechanism 34, a bearing housing assembly 36, a motor assembly 38 and an end bearing 40. While the second compressor 14 shown in FIG. 2 is a high-side-compressor (i.e., where the motor assembly 38 is disposed in a discharge-pressure chamber of the shell 32), the principles of the present disclosure are suitable for incorporation in many different types of compressors, including low-side compressors (i.e., where the motor assembly 38 is disposed in a suction-pressure chamber of the shell 32).

The shell 32 houses the compression mechanism 34, the bearing housing assembly 36, the motor assembly 38, and the end bearing 40. The shell 32 includes a cylindrical main body 42, a first end cap 44 that fits over and sealing engages one end of the main body 42, and a second end cap 46 that fits over and sealing engages the other end of the main body 42. A suction tube or suction fitting 48 extends through the first end cap 44 of the shell 32 and receives a working fluid at a suction pressure from the third heat exchanger 20 of the climate control system 10. A discharge tube or discharge fitting 50 extends through the second end cap 46 of the shell 32 and discharges working fluid from the compression mechanism 34 to the first fluid passageway 26 via a discharge line 51 where it mixes with working fluid exiting the second heat exchanger 18 before flowing into the first compressor 12. A check valve 53 may be disposed along the discharge line 51.

The shell 32 defines a discharge chamber 52 (containing discharge-pressure fluid) in which the compression mechanism 34, the bearing housing assembly 36, the motor assembly 38, and the end bearing 40 are disposed. The second compressor 14 is depicted as a sumpless compressor—i.e., the second compressor 14 does not include a lubricant sump. Instead, lubricating fluid entrained in working fluid entering into the second compressor 14 and discharged from the compression mechanism 34 circulates throughout the shell 32 and lubricates various moving components of the second compressor 14.

The compression mechanism 34 includes an orbiting scroll member 54 and a non-orbiting scroll member 56. The non-orbiting scroll member 56 is fixed to the shell 32 (e.g., by press fit and/or staking) and/or to the bearing housing assembly 36 (e.g., by a plurality of fasteners). The non-orbiting scroll member 56 has a suction inlet 57 in fluid communication with the suction tube 48. The orbiting and non-orbiting scroll members 54, 56 include orbiting and non-orbiting spiral wraps (or vane) 58, 60, respectively, that meshingly engage each other and extend axially from orbiting and non-orbiting baseplates 62, 64, respectively. The orbiting scroll member 54 further includes a hub or tubular portion 66 that extends axially from the side of the orbiting baseplate 62 that is opposite of the side of the baseplate 62 from which the orbiting spiral wraps 58 extend. The tubular portion 66 defines a driveshaft cavity 68.

A driveshaft 70 rotates about a rotational axis A and has a first end 72 disposed in the driveshaft cavity 68 and a second end 74 opposite of the first end 72. The driveshaft 70 drivingly engages the orbiting scroll member 54, via a drive bearing 76 and an unloader bushing 78, to cause orbital movement of the orbiting scroll member 54 relative to the non-orbiting scroll member 56. The drive bearing 76 and the unloader bushing 78 are disposed in a drive bearing cavity 80, which is disposed between an outer radial surface 82 of the driveshaft 70 and an inner radial surface 84 of the tubular portion 66 of the orbiting scroll member 54. The drive bearing 76 and/or the unloader bushing 78 can be made from steel or other materials used in rolling element bearing designs. The drive bearing 76 can be press fit into the drive bearing cavity 80 of the orbiting scroll member 54. The unloader bushing 78 may be coupled to the driveshaft 70 in a manner that ensures that the unloader bushing 78 rotates or orbits with the driveshaft 70 while allowing some radial compliance between the driveshaft 70 and the unloader bushing 78. For example, the outer radial surface 82 of the driveshaft 70 may include a flat portion that engages a flat portion on an inner radial surface 83 of the unloader bushing 78 to prevent the unloader bushing 78 from rotating relative to the driveshaft 70. In addition, the unloader bushing 78 may include a spring (not shown) disposed between the outer radial surface 82 of the driveshaft 70 and the inner radial surface 83 of the unloader bushing 78, and the compliance of the spring may allow the orbiting scroll member 54 to move radially relative to the driveshaft 70. The orbiting scroll member 54 may only move radially relative to the driveshaft 70 when a radial force applied to the orbiting scroll member 54 is greater than a biasing force of the spring.

The unloader bushing 78 is disposed about the driveshaft 70 adjacent to the first end 72 of the driveshaft 70 and is disposed between the outer radial surface 82 of the driveshaft 70 and an inner radial surface 86 of the drive bearing 76. The drive bearing 76 is disposed about the driveshaft 70 adjacent to the first end 72 of the driveshaft 70 and is disposed between the unloader bushing 78 and the inner radial surface 83 of the tubular portion 66 of the orbiting scroll member 54. Although radial gaps are shown between the driveshaft 70, the unloader bushing 78, the drive bearing 76, and the orbiting scroll member 54 to illustrate fluid flow between these components, these components may engage one another such that rotation of the driveshaft 70 is transferred to the orbiting scroll member 54.

An Oldham coupling 90 is keyed to the orbiting scroll member 54 and a stationary structure (e.g., the bearing housing assembly 36 or the non-orbiting scroll member 56) to prevent relative rotation between the orbiting and non-orbiting scroll members 54, 56 while allowing the orbiting scroll member 54 to move in an orbital path relative to the non-orbiting scroll member 56. Compression pockets 92 are formed between the orbiting and non-orbiting spiral wraps 58, 60 that decrease in size as they move from a radially outer position to a radially inner position, thereby compressing the working fluid therein from the suction pressure to the discharge pressure.

The baseplate 62 of the orbiting scroll member 54 defines a discharge passage 94 that extends axially through the baseplate 62 and discharges working fluid to the drive bearing cavity 80 after it has been compressed by the compression mechanism 34. The discharge passage 94 is located at or near the center of the orbiting scroll member 54 in the radial direction. The orbiting scroll member 54 has an axial end surface 95 that faces the driveshaft 70, and the first end 72 of the driveshaft 70 is spaced apart from the axial end surface 95 to provide a clearance gap 96. The clearance gap 96 is free of any seal that prevents fluid communication between the discharge passage 94 in the orbiting scroll member 54 and the drive bearing cavity 80. Thus, the discharge passage 94 is in fluid communication with the drive bearing cavity 80, which is disposed within the discharge chamber 52, and lubricating fluid entrained in the discharge fluid lubricates the drive bearing 76 and the unloader bushing 78.

The baseplate 64 of the non-orbiting scroll member 56 defines a discharge passage 97 that extends axially through the baseplate 64 and discharges working fluid to the discharge chamber 52 after it has been compressed by the compression mechanism 34. In addition, a discharge valve 98 regulates the flow of the discharge fluid through the discharge passage 97 in the non-orbiting scroll member 56. The discharge valve 98 may be a reed valve, a disc valve, or any other type of dynamic valve. The discharge passage 97 in the non-orbiting scroll member 56 may be at least partially aligned with the discharge passage 94 in the orbiting scroll member 54 in the radial direction. In various configurations, the discharge passage 97 and the discharge valve 98 may be omitted, which would enable reducing the size of the second compressor 14 by reducing the size of (or eliminating) the gap between an axial end surface 99 of the non-orbiting scroll member 56 and the first end cap 44 of the shell 32.

The bearing housing assembly 36 includes a main bearing housing 100 and a main bearing 102. The main bearing housing 100 is fixed relative to the shell 32 and defines a thrust bearing surface 104 for the orbiting scroll member 54. The main bearing housing 100 and the main bearing 102 radially support the driveshaft 70.

The main bearing housing 100 includes a first tubular portion 106, a first annular portion 108 that projects radially inward from the first tubular portion 106, a second annular portion 110 that projects radially outward from the first tubular portion 106, and a second tubular portion 112 that extends axially from the outer radial ends of the second annular portion 110. The first tubular portion 106 of the main bearing housing 100 defines a main bearing cavity 114 that receives the main bearing 102 and the driveshaft 70, and that is in fluid communication with the drive bearing cavity 80. Thus, discharge fluid flows from the drive bearing cavity 80 to the main bearing cavity 114, and lubricating fluid entrained in discharge gas lubricates the main bearing 102. The first annular portion 108 of the main bearing housing 100 defines the thrust bearing surface 104. The second tubular portion 112 of the main bearing housing 100 defines an antithrust surface 115 that abuts the non-orbiting scroll member 56.

The orbiting and non-orbiting scroll members 54, 56 and the main bearing housing 100 cooperate to define an intermediate chamber 116 that is disposed between the orbiting and non-orbiting scroll members 54, 56 and the main bearing housing 100. The Oldham coupling 90 is disposed in the intermediate chamber 116. An annular seal 118 is disposed at an interface between the orbiting scroll member 54 and the main bearing housing to prevent fluid communication between the intermediate chamber 116 and the discharge chamber 52.

The baseplate 62 of the orbiting scroll member 54 defines an intermediate chamber orifice 120 that extends axially through the baseplate 62 and is disposed radially between the discharge passage 94 and the suction inlet 57. The intermediate chamber orifice 120 places the compression pockets 92 in fluid communication with the intermediate chamber 116, thereby allowing working fluid at an intermediate pressure (i.e., a pressure greater than the suction pressure and less than the discharge pressure) to flow between the compression pockets 92 and the intermediate chamber 116. Lubricating fluid entrained in the intermediate fluid lubricates the Oldham coupling 90, the interface between the thrust bearing surface 104 of the main bearing housing 100 and the orbiting scroll member 54, and the interface between the antithrust surface 115 of the main bearing housing 100 and the non-orbiting scroll member 56.

The driveshaft 70 defines a first channel 122 extending axially through the first end 72 of the driveshaft 70 and a second channel 124 extending radially outward from the first channel 122 and through the outer radial surface 82 of the driveshaft 70. Discharge gas from the discharge passage 94 of the orbiting scroll member 54 and lubricating fluid entrained in the discharge gas may flow though the first and second channels 122, 124 and may lubricate the interface between the outer radial surface 82 of the driveshaft 70 and the inner radial surface 83 of the unloader bushing 78. The driveshaft 70 also defines a third channel 128 extending axially from the first channel 122 and through the second end 74 of the driveshaft 70. However, in various configurations, the driveshaft 70 may define the first and second channels 122, 124 without also defining the third channel 128.

The motor assembly 38 includes a stator 130 and a rotor 132. The motor assembly 38 can be a fixed-speed motor or a variable-speed motor. In some configurations, the motor assembly 38 may be an induction motor. In other configurations, the motor assembly 38 may be a switched reluctance motor. The stator 130 is disposed about the rotor 132 and includes a conductive member 134, such as copper wire, that generates a magnetic field, which causes the rotor 132 to rotate about the rotational axis A.

The rotor 132 is disposed about the stator 130 and is coupled to the driveshaft 70. In this regard, the rotor 132 may transmit rotational power to the driveshaft 70. The rotor 132 defines a central aperture 136 that receives the driveshaft 70 and is disposed about a portion of the driveshaft 70 located between the first and second ends 72, 74 of the driveshaft 70. The rotor 132 may be fixed relative to the driveshaft 70 by press fitting the driveshaft 70 within the central aperture 136. One or more additional or alternative means for fixing the driveshaft 70 to the rotor 132 could be employed, such as threaded engagement, adhesive bonding and/or fasteners, for example.

The first tubular portion 106 of the main bearing housing 100 has an open end 138 that allows discharge fluid to flow from the main bearing cavity 114 to the motor assembly 38. In addition, discharge fluid expelled through the discharge passage 97 in the non-orbiting scroll member 56 may flow radially outward and then axially past the compression mechanism 34 and the bearing housing assembly 36 to the motor assembly 38. In this regard, the non-orbiting scroll member 56 may define one or more fluid passages 140 extending axially through the non-orbiting scroll member 56, and the main bearing housing 100 may define one or more fluid passages 141 that extend axially through the main bearing housing 100 and that are radially aligned with the fluid passages 140. Thus, the discharge fluid expelled through the discharge passage 97 may flow through the fluid passages 140, 141 in the non-orbiting scroll member 56 and the main bearing housing 100, respectively, and to the motor assembly 38. In this regard, the discharge chamber 52 includes a first portion 142 disposed on a first side of the compression mechanism 34 and a second portion 143 disposed on a second side of the compression mechanism 34 opposite of the first side, and the fluid passages 140, 141 place the first portion 142 of the discharge chamber 52 in fluid communication with the second portion 143 of the discharge chamber 52.

Lubricating fluid entrained in the discharge fluid that flows to the motor assembly 38 may lubricate the interface between the shell 32 and the stator 130 and the interface between the rotor 132 and the driveshaft 70. In addition, the stator 130 may define one or more fluid passages 144 extending axially through the stator 130 and allowing the discharge fluid to flow through the stator 130 to the end bearing 40.

The end bearing 40 is disposed about the driveshaft 70 adjacent to the second end 74 of the driveshaft 70 and radially supports the driveshaft 70. Discharge fluid flows through the end bearing 40 after it passes through the motor assembly 38, and lubricating fluid entrained in the discharge fluid lubricates the end bearing 40. The discharge fluid then exits the second compressor 14 through the discharge tube 50. The discharge tube 50 may be located near the bottom of the second compressor 14 so that little to no lubricating fluid accumulates in the second compressor 14. This ensures that the amount of lubricating fluid flowing through the second compressor 14 is constant or fixed.

Referring back to FIG. 1, the first heat exchanger 16 may receive compressed working fluid from the first compressor 12 via the discharge line 30, and may transfer heat from the compressed working fluid to ambient air that may be forced over the first heat exchanger 16 by a fan (not shown). In some configurations, the first heat exchanger 16 may transfer heat from the compressed working fluid to a stream of liquid such as water, for example. From the first heat exchanger 16, a first portion of the working fluid flows into a second fluid passageway 150 and a second portion the working fluid may flow through a third fluid passageway 152.

The second fluid passageway 150 may include a first expansion device 154 (e.g., an expansion valve or capillary tube) and the second heat exchanger 18 that is disposed within a medium-temperature display case (e.g., refrigerator). The working fluid in the second fluid passageway 150 flows through the first expansion device 154 where its temperature and pressure is lowered. In the second heat exchanger 18, the working fluid may absorb heat from a first space to be cooled (e.g., an interior of a refrigerator, a refrigerated display case, or a cooler). From the second heat exchanger 18, the working fluid flows to the first fluid passageway 26 and into the first compressor 12 via the suction line 28 and the inlet 22.

The third fluid passageway 152 may include a second expansion device 158 and the third heat exchanger 20. The working fluid in the third fluid passageway 152 flows through the second expansion device 158 where its temperature and pressure is lowered. In the third heat exchanger 20, the working fluid may absorb heat from a second space to be cooled (e.g., freezer or a frozen food display case). In some configurations, the working fluid in the second heat exchanger 18 of the second fluid passageway 150 and the working fluid in the third heat exchanger 20 of the third fluid passageway 152 may absorb heat from the same space (e.g., the second heat exchanger 18 of the second fluid passageway 150 and the third heat exchanger 20 of the third fluid passageway 152 may operate at different times to switch the space between a freezer and a cooler, for example). From the third heat exchanger 20, the working fluid flows into the second compressor 14 via a suction line 155 and the inlet 48.

A bypass passageway 162 may extend from the discharge line of the first compressor 12 at a location between the first heat exchanger 16 and the first compressor 12 to the suction line 155 of the second compressor 12. A bypass valve 166 may be disposed along the bypass passageway 162 and may be movable between open and closed positions. When in the open position, compressed working fluid exiting the first compressor 12 may flow through the bypass passageway 162 and to the second compressor 14 via the suction line 155 and the inlet 48. When in the closed position, compressed working fluid exiting the first compressor 12 may be prevented from flowing through the bypass passageway 162, thereby flowing into the first heat exchanger 16.

A lubricant passageway 164 may extend from a second outlet 167 of the first compressor 12 to the suction line 155 of the second compressor 12. The lubricant passageway 164 may be in fluid communication with an oil sump 168 of the first compressor 12. A bypass valve 170 may be disposed along the lubricant passageway 164 and may be movable between open and closed positions. When in the open position, lubricant may exit the oil sump 168 of the first compressor 12 and may flow through the lubricant passageway 164 and to the second compressor 14 via the suction line 155 and the inlet 48. When in the closed position, lubricant is prevented from flowing from the oil sump 168 of the first compressor 12 through the lubricant passageway 164 and into the second compressor 14.

As shown in FIG. 3, the control module 23 may be in communication with the first compressor 12, the second compressor 14, the expansion devices 154, 158, and the valves 166, 170, for example. The control module 23 can control operation of the first and second compressors 12, 14 and can open and close the valves 166, 170 in order to provide efficient and reliable operation of the system 10.

In a Micro Booster climate-control system, compressed working fluid from the second compressor 14 (e.g., a low-temperature compressor) flows into the first compressor 12 (e.g., a medium-temperature compressor). Due to the second compressor 14 being a sumpless compressor, sufficient lubrication is needed upon start-up to ensure efficient and effective operation of the second compressor 14 and the system 10.

Figure 4:
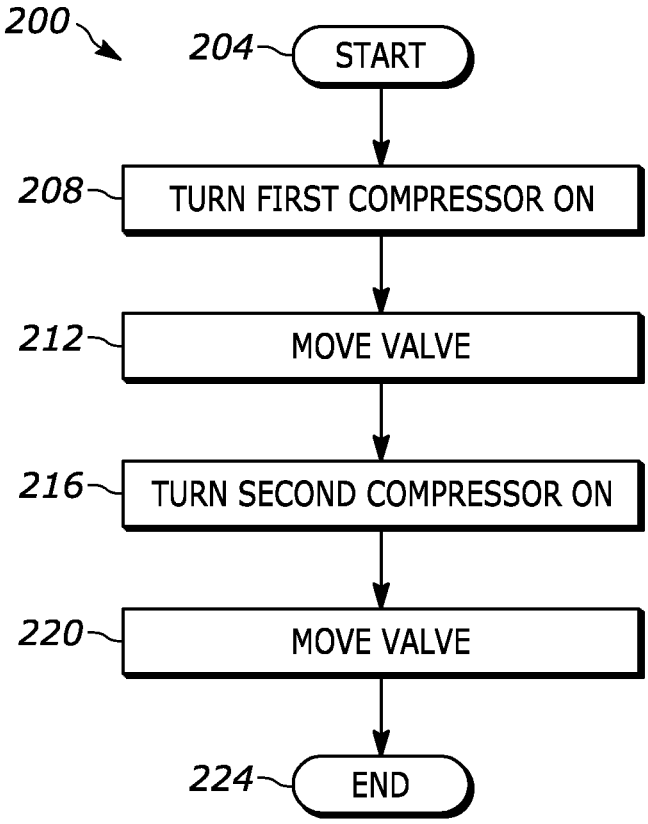
FIG. 4 is a flowchart depicting an algorithm for providing oil of one compressor to another compressor of the climate-control system of FIG. 1.

With reference to FIG. 4, a flowchart 200 showing an example implementation of a control algorithm for providing lubricant (e.g., oil) to a second compressor 14 (i.e., sumpless compressor) in a refrigeration system is shown. The control algorithm begins at 204 upon receiving a start command (e.g., the climate-control system 10 may start in response to at least one of the first and second compressors 12, 14 receiving a demand signal). At 208, the control algorithm, using the control module 23, turns the first compressor 12 to an ON-mode. After turning the first compressor 12 to the ON-mode, the control algorithm then proceeds to 212.

At 212, the control algorithm, using the control module 23, moves the valve 166 from the closed position to the open position. This is done approximately 1-5 seconds after the first compressor 12 has been turned to the ON-mode. It should be understood that the valve 166 may be moved to the open position simultaneously with the first compressor 12 being turned to the ON-mode.

Moving the valve 166 to the open position allows a portion of the compressed working fluid discharged from the first compressor 12 and containing lubricant entrained therein to flow to the second compressor 14 via the suction line 155 and the inlet 48. After moving the valve 166 from the closed position to the open position, the control algorithm then proceeds to 216.

At 216, the control algorithm, using the control module 23, turns the second compressor 14 to an ON-mode. This is done approximately 1 second after the valve 166 has been moved to the open position. It should be understood that the second compressor 14 may be turned to the ON-mode simultaneously with moving the valve 166 to the open position. After turning the second compressor 14 to the ON-mode, the control algorithm then proceeds to 220.

At 220, the control algorithm, using the control module 23, moves the valve 166 from the open position to the closed position. This is done approximately 10-30 seconds after the second compressor 14 has been turned to the ON-mode. In this way, sufficient lubricant is provided from the first compressor 12 to the second compressor 14 to lubricate internal components (e.g., the compression mechanism 34, the bearing assembly 36 and the motor assembly 38 of the second compressor 14) before or during start-up of the second compressor 14. The control module 23 then proceeds to 224 and ends.

Figure 5:
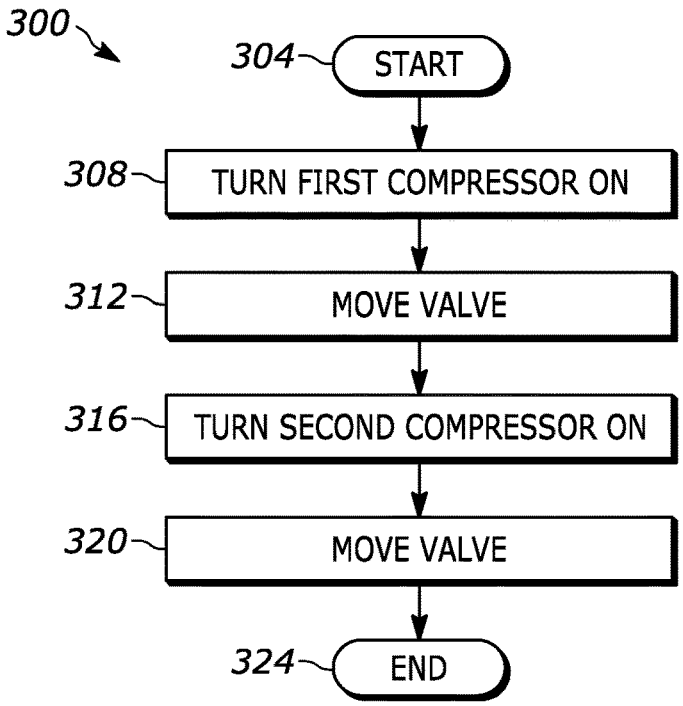
FIG. 5 is a flowchart depicting an algorithm for providing oil of one compressor to another compressor of the climate-control system of FIG. 1.

With reference to FIG. 5, a flowchart 300 showing an example implementation of a control algorithm for providing lubricant (e.g., oil) to a second compressor 14 (i.e., sumpless compressor) in a refrigeration system is shown. The control algorithm begins at 304 upon receiving a start command (e.g., the climate-control system 10 may start in response to at least one of the first and second compressors 12, 14 receiving a demand signal). At 308, the control algorithm, using the control module 23, turns the first compressor 12 to an ON-mode. It should be understood that in some configurations, the first compressor 12 may be left in the Off-mode while lubricant is being provided to the second compressor 14. After turning the first compressor 12 to the ON-mode, the control algorithm then proceeds to 312.

At 312, the control algorithm, using the control module 23, moves the valve 170 from the closed position to the open position. This is done approximately 1-5 seconds after the first compressor 12 has been turned to the ON-mode. It should be understood that the valve 170 may be moved to the open position simultaneously with the first compressor 12 being turned to the ON-mode.

Moving the valve 170 to the open position allows lubricant contained in the oil sump 168 to flow to the second compressor 14 (via the lubricant passageway 164, the suction line 155 and the inlet 48). After moving the valve 170 from the closed position to the open position, the control algorithm then proceeds to 316.

At 316, the control algorithm, using the control module 23, turns the second compressor 14 to an ON-mode. This is done approximately 1-3 seconds after the valve 170 has been moved to the open position. It should be understood that the second compressor 14 may be turned to the ON-mode simultaneously with moving the valve 170 to the open position. After turning the second compressor 14 to the ON-mode, the control algorithm then proceeds to 320.

At 320, the control algorithm, using the control module 23, moves the valve 170 from the open position to the closed position. This is done approximately 1-10 seconds after the second compressor 14 has been turned to the ON-mode. In this way, sufficient lubricant is provided from the first compressor 12 to the second compressor 14 to lubricate internal components (e.g., the compression mechanism 34, the bearing assembly 36 and the motor assembly 38 of the second compressor 14) before or during start-up of the second compressor 14. The control module 23 then proceeds to 324 and ends.

Figure 6:
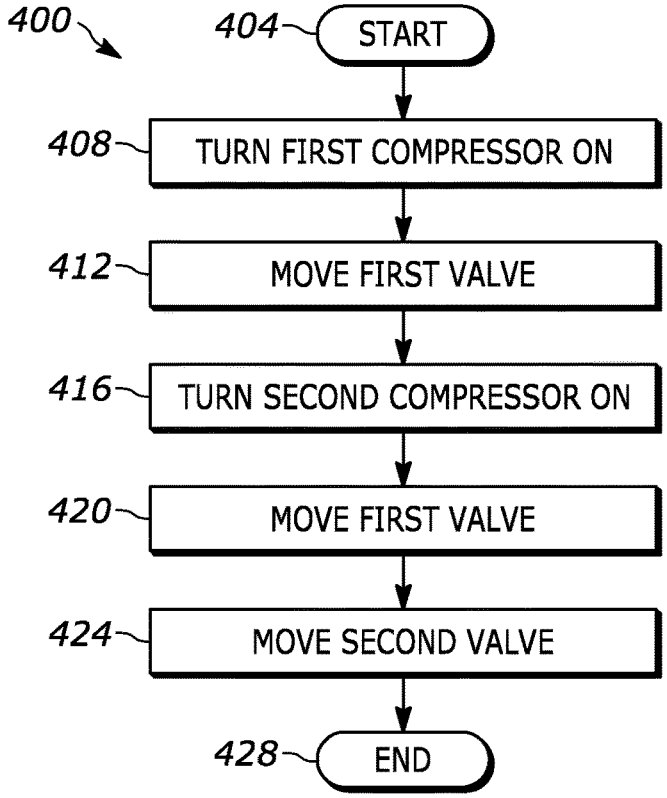
FIG. 6 is a flowchart depicting an algorithm for providing oil of one compressor to another compressor of the climate-control system of FIG. 1.

With reference to FIG. 6, a flowchart 400 showing an example implementation of a control algorithm for providing lubricant (e.g., oil) to a second compressor 14 (i.e., sumpless compressor) in a refrigeration system is shown. The control algorithm begins at 404 upon receiving a start command (e.g., the climate-control system 10 may start in response to at least one of the first and second compressors 12, 14 receiving a demand signal). At 408, the control algorithm, using the control module 23, turns the first compressor 12 to an ON-mode. After turning the first compressor 12 to the ON-mode, the control algorithm then proceeds to 412.

At 412, the control algorithm, using the control module 23, moves the valve 170 from the closed position to the open position. This is done approximately 1-5 seconds after the first compressor 12 has been turned to the ON-mode. It should be understood that the valve 170 may be moved to the open position simultaneously with the first compressor 12 being turned to the ON-mode.

Moving the valve 170 to the open position allows lubricant contained in the oil sump 168 to flow to the second compressor 14 (via the lubricant passageway 164, the suction line 155 and the inlet 48). After moving the valve 170 from the closed position to the open position, the control algorithm then proceeds to 416.

At 416, the control algorithm, using the control module 23, turns the second compressor 14 to an ON-mode. This is done approximately 1-5 seconds after the valve 170 has been moved to the open position. It should be understood that the second compressor 14 may be turned to the ON-mode simultaneously with moving the valve 170 to the open position. After turning the second compressor 14 to the ON-mode, the control algorithm then proceeds to 420.

At 420, the control algorithm, using the control module 23, moves the valve 170 from the open position to the closed position. This is done approximately 5-10 seconds after the second compressor 14 has been turned to the ON-mode. In this way, sufficient lubricant is provided from the first compressor 12 to the second compressor 14 to lubricate internal components (e.g., the compression mechanism 34, the bearing assembly 36 and the motor assembly 38 of the second compressor 14). After moving the valve 170 from the open position to the closed position, the control algorithm then proceeds to 424.

At 424, the control algorithm, using the control module 23, moves the valve 166 from the closed position to the open position. This is done approximately 1-3 seconds after moving the valve 170 from the open position to the closed position. In some configurations, this is done simultaneously with moving the valve 170 from the open position to the closed position. Moving the valve 166 from the closed position to the open position allows lubricant entrained in the compressed working fluid discharged from the first compressor 12 to flow to the second compressor 14 via the bypass passageway 162 to further lubricate internal components (e.g., the compression mechanism 34, the bearing assembly 36 and the motor assembly 38 of the second compressor 14) of the second compressor 14. The valve 166 is left open for a predetermined time period (e.g., between 1-5 seconds) then moved back to the closed position. After moving the valve 166 to the closed position, the control module 23 then proceeds to 428 and ends.

It should be understood that in some configurations, lubricant entrained in the working fluid may be provided to the second compressor 12 (via the bypass passageway 162) before lubricant contained in the oil sump 168 is provided to the second compressor 12 (via the lubricant passageway 164).

Figure 7:
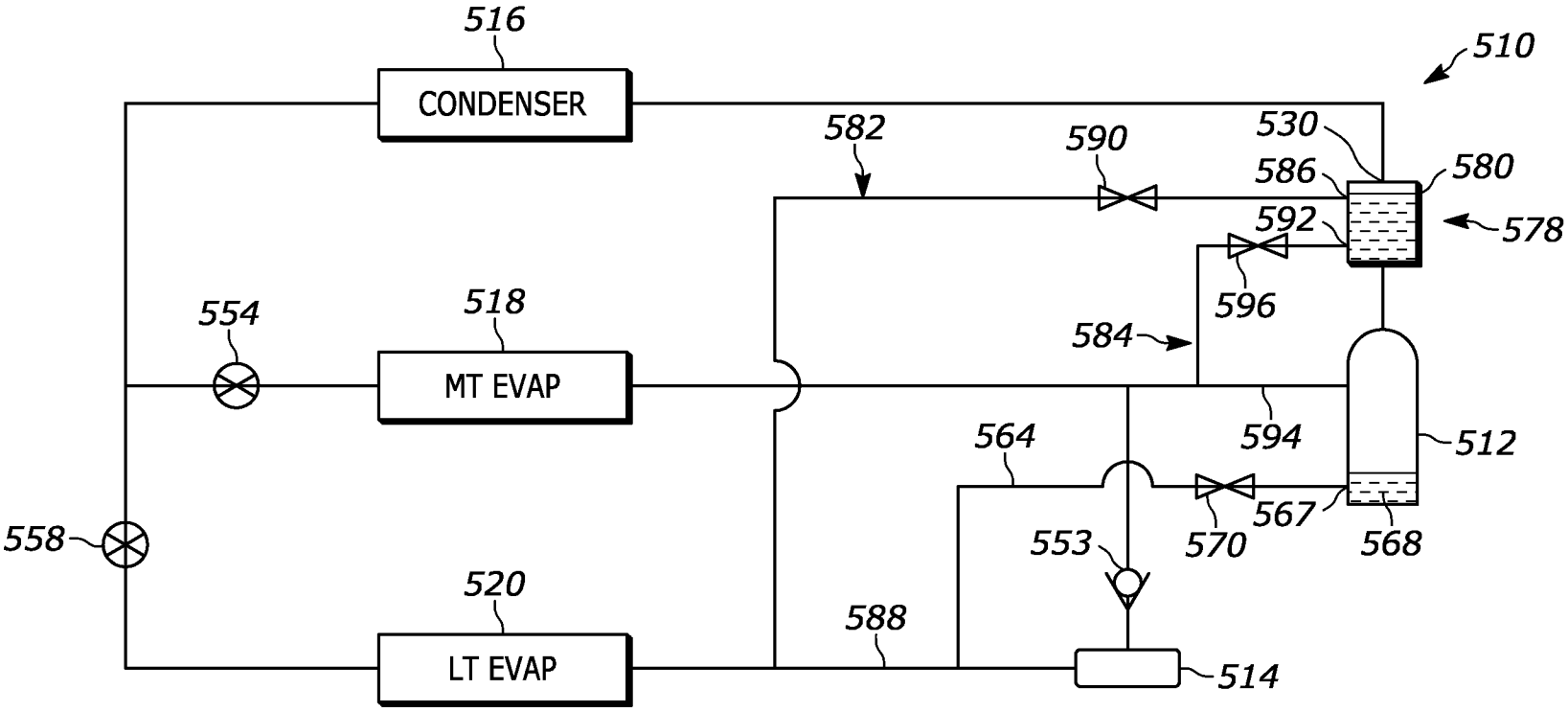
FIG. 7 is another schematic representation of a climate-control system according to the principles of the present disclosure.
Figure 8:
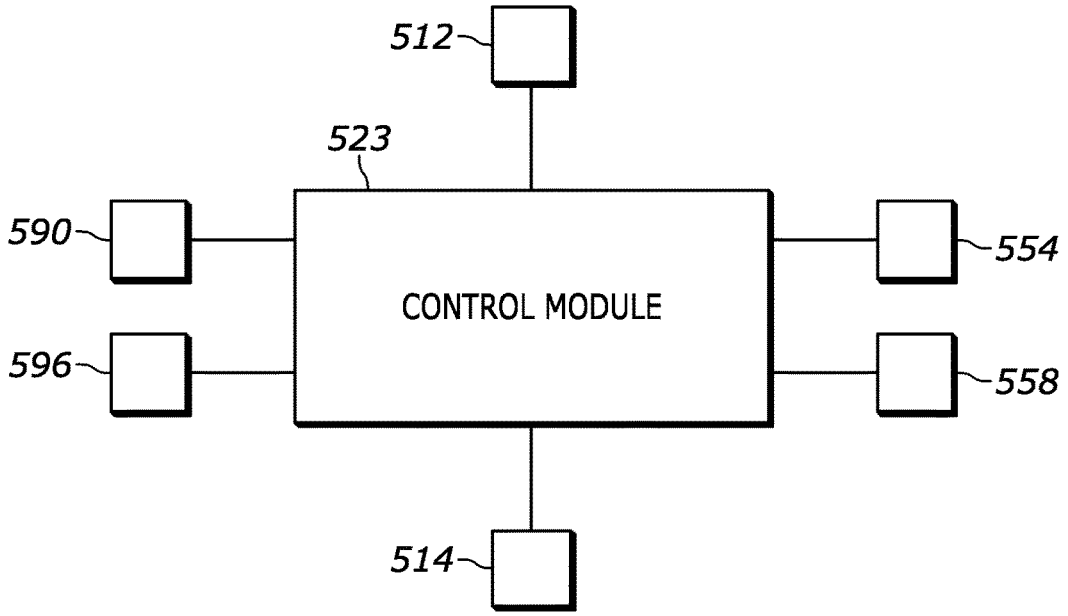
FIG. 8 is a block diagram illustrating communication between a control module and components of the climate-control system of FIG. 7.

With reference to FIGS. 7 and 8, another climate control system 510 is provided that may be generally similar to the climate-control system 10 described above, apart from any exceptions noted below. The climate-control system 510 may include a fluid-circuit having one or more first compressors 512, one or more second compressors 514, a first heat exchanger 516 (an outdoor heat exchanger such as a condenser or gas cooler, for example), a second heat exchanger 518, (an indoor heat exchanger such as a medium-temperature evaporator, for example) a third heat exchanger 520 (an indoor heat exchanger such as a low-temperature evaporator, for example) and a control module 523 (FIG. 8). The structure and function of the first compressor 512, the second compressor 514, the first heat exchanger 516, the second heat exchanger 518, the third heat exchanger 520 and the control module 523 may be similar or identical to that of the first compressor 12, the second compressor 14, the first heat exchanger 16, the second heat exchanger 18, the third heat exchanger 20 and the control module 23, respectively, described above, and therefore, will not be described again in detail.

The structure and function of a first expansion device 554, a second expansion device 558 and a check valve 553 may be similar or identical to that of the first expansion device 154, the second expansion device 158 and the check valve 53, respectively, described above, and therefore, will not be described again in detail.

An oil apparatus 578 may include an oil separator 580, a first lubricant passageway 582 and a second lubricant passageway 584. The oil separator 580 is disposed along a discharge line 530 such that compressed working fluid discharged from the first compressor 512 passes through the oil separator 580 and at least a portion of the lubricant (e.g., oil) therein is entrapped in the oil separator 580.

The first lubricant passageway 582 may extend from a first outlet 586 of the oil separator 580 to a suction line 588 of the second compressor 514. The first lubricant passageway 582 may be in fluid communication with lubricant in the oil separator 580. A valve 590 may be disposed along the first lubricant passageway 582 and may be movable between open and closed positions. When in the open position, lubricant may exit the oil separator 580 and may flow through the first lubricant passageway 582 and to the second compressor 514. When in the closed position, lubricant is prevented from flowing from the oil separator 580 through the first lubricant passageway 582 and into the second compressor 514.

The second lubricant passageway 584 may extend from a second outlet 592 of the oil separator 580 to a suction line 594 of the first compressor 512. The second lubricant passageway 584 may be in fluid communication with lubricant in the oil separator 580. A valve 596 may be disposed along the second lubricant passageway 584 and may be movable between open and closed positions. When in the open position, lubricant may exit the oil separator 580 and may flow through the second lubricant passageway 584 and to the first compressor 512. When in the closed position, lubricant is prevented from flowing from the oil separator 580 through the second lubricant passageway 584 and into the first compressor 512.

A lubricant passageway 564 may extend from a second outlet 567 of the first compressor 512 to the suction line 588 of the second compressor 514. The lubricant passageway 564 may be in fluid communication with an oil sump 568 of the first compressor 512. A bypass valve 570 may be disposed along the lubricant passageway 564 and may be movable between open and closed positions. When in the open position, lubricant may exit the oil sump 568 of the first compressor 512 and may flow through the lubricant passageway 564 and to the second compressor 514 via the suction line 588. When in the closed position, lubricant is prevented from flowing from the oil sump 568 of the first compressor 512 through the lubricant passageway 564 and into the second compressor 514.

As shown in FIG. 8, the control module 523 may be in communication with the first compressor 512, the second compressor 514, the expansion devices 554, 558, and the valves 590, 596, for example. The control module 523 can control operation of the first and second compressors 512, 514 and can open and close the valves 590, 596 in order to provide efficient and reliable operation of the system 510.

Figure 9:
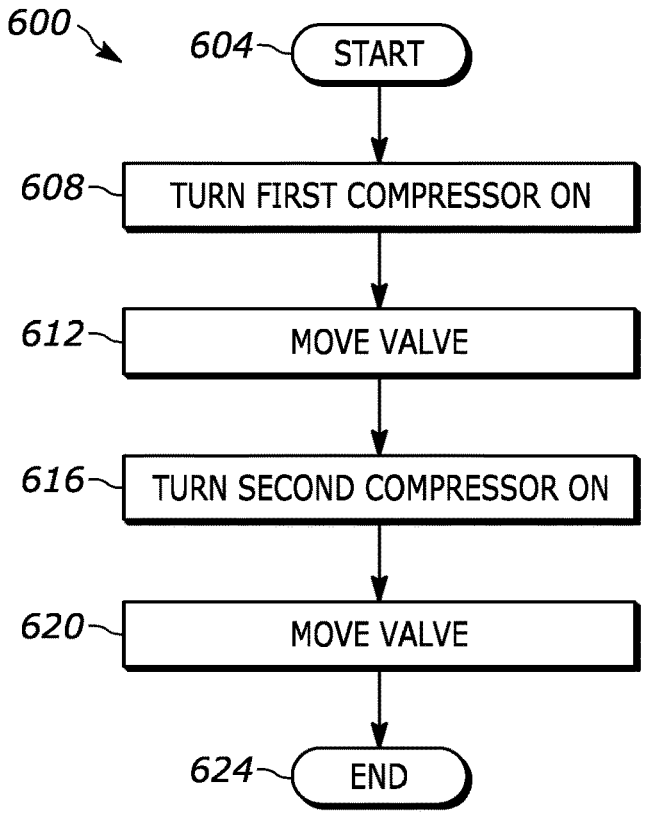
FIG. 9 is a flowchart depicting an algorithm for providing oil of one compressor to another compressor of the climate-control system of FIG. 7.

With reference to FIG. 9, a flowchart 600 showing an example implementation of a control algorithm for providing lubricant (e.g., oil) to a second compressor 514 (i.e., sumpless compressor) in a refrigeration system is shown. The control algorithm begins at 604 upon receiving a start command (e.g., the climate-control system 510 may start in response to at least one of the first and second compressors 512, 514 receiving a demand signal). At 608, the control algorithm, using the control module 523, turns the first compressor 512 to an ON-mode. It should be understood that in some configurations, the first compressor 512 may be left in the Off-mode while lubricant is being provided to the second compressor 514. After turning the first compressor 512 to the ON-mode, the control algorithm then proceeds to 612.

At 612, the control algorithm, using the control module 523, moves the valve 590 from the closed position to the open position. This is done approximately 1-5 seconds after the first compressor 512 has been turned to the ON-mode. It should be understood that the valve 590 may be moved to the open position simultaneously with the first compressor 512 being turned to the ON-mode.

Moving the valve 590 to the open position allows lubricant contained in the oil separator 580 to flow to the second compressor 514 (via the first lubricant passageway 582).

After moving the valve 590 from the closed position to the open position, the control algorithm then proceeds to 616.

At 616, the control algorithm, using the control module 523, turns the second compressor 514 to an ON-mode. This is done approximately 1-3 seconds after the valve 590 has been moved to the open position. It should be understood that the second compressor 514 may be turned to the ON-mode simultaneously with moving the valve 590 to the open position. After turning the second compressor 514 to the ON-mode, the control algorithm then proceeds to 620.

At 620, the control algorithm, using the control module 523, moves the valve 590 from the open position to the closed position. This is done approximately 1-10 seconds after the second compressor 514 has been turned to the ON-mode. In this way, sufficient lubricant is provided from the oil separator 580 to the second compressor 514 to lubricate internal components (e.g., the compression mechanism, the bearing assembly and the motor assembly of the second compressor 514) before or during start-up of the second compressor 514. The control module 523 then proceeds to 624 and ends.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method comprising:

receiving a start command for a climate-control system having first and second compressors, the second compressor configured to provide compressed working fluid to an inlet of the first compressor;

allowing lubricant from the first compressor to flow into an inlet of the second compressor, the second compressor being a sumpless compressor;

turning the second compressor to an ON-mode; and preventing lubricant from the first compressor from flowing into the inlet of the second compressor after the second compressor has been in the ON-mode for a predetermined time period.

2. The method of claim 1, wherein the first compressor is in an OFF-mode, and where lubricant flows from an oil sump of the first compressor to the inlet of the second compressor.

3. The method of claim 2, wherein the climate control system includes a lubricant passageway in fluid communication with the oil sump of the first compressor and the inlet of the second compressor, and wherein the lubricant flows from the oil sump of the first compressor to the inlet of the second compressor via the lubricant passageway.

4. The method of claim 1, wherein the first compressor is turned to an ON-mode in response to receiving the start command, and wherein lubricant is entrained in compressed working fluid that is discharged from an outlet of the first compressor to the inlet of the second compressor.

5. The method of claim 4, wherein the climate control system includes a bypass passageway in fluid communication with the outlet of the first compressor and the inlet of the second compressor, and wherein compressed working fluid having lubricant entrained therein flows from the outlet of the first compressor to the inlet of the second compressor via the bypass passageway.

6. The method of claim 1, wherein the predetermined time period is between 1 second and 30 seconds.

7. The method of claim 1, wherein the second compressor is a horizontal sumpless compressor.

8. A method comprising:

receiving a start command for a climate-control system having first and second compressors, the second compressor configured to provide compressed working fluid to an inlet of the first compressor;

allowing lubricant to flow from a first region of the first compressor into an inlet of the second compressor, the second compressor being a sumpless compressor;

turning the second compressor to an ON-mode;

preventing lubricant from the first region of the first compressor from flowing into the inlet of the second compressor after the second compressor has been in the ON-mode for a predetermined time period; and allowing lubricant to flow from a second region of the first compressor into the inlet of the second compressor, the second region being different from the first region.

9. The method of claim 8, wherein lubricant is allowed to flow from the second region of the first compressor into the inlet of the second compressor after lubricant is prevented from flowing from the first region of the first compressor into the inlet of the second compressor.

10. The method of claim 8, wherein the first region is an oil sump of the first compressor and the second region is a discharge chamber of the first compressor.

11. The method of claim 10, wherein the first compressor is in an OFF-mode, and wherein lubricant flows from the oil sump of the first compressor to the inlet of the second compressor via a lubricant passageway that is in fluid communication with the oil sump and the inlet of the first compressor.

12. The method of claim 10, wherein the first compressor is turned to an ON-mode in response to receiving the start command, and wherein lubricant in the discharge chamber is entrained in compressed working fluid that is discharged from the discharge chamber and flowing to the inlet of the second compressor.

13. The method of claim 12, wherein the climate control system includes a bypass passageway in fluid communication with the discharge chamber of the first compressor and the inlet of the second compressor, and wherein compressed working fluid having lubricant entrained therein flows from the discharge chamber of the first compressor to the inlet of the second compressor via the bypass passageway.

14. The method of claim 8, wherein the second compressor is a horizontal sumpless compressor.

15. The method of claim 8, wherein the predetermined time period is between 1 second and 30 seconds.

16. A method comprising:

receiving a start command for a climate-control system having first and second compressors, the second compressor configured to provide compressed working fluid to an inlet of the first compressor;

allowing lubricant from an oil separator to flow into an inlet of the second compressor, the second compressor being a sumpless compressor;

turning the second compressor to an ON-mode; and preventing lubricant from the oil separator from flowing into the inlet of the second compressor after the second compressor has been in the ON-mode for a predetermined time period.

17. The method of claim 16, wherein the oil separator is disposed along a discharge line of the first compressor.

18. The method of claim 16, wherein the climate control system includes a first lubricant passageway in fluid communication with the oil separator and the inlet of the second compressor, and wherein the lubricant flows from the oil separator to the inlet of the second compressor via the first lubricant passageway.

19. The method of claim 18, further comprising allowing lubricant from the oil separator to flow into the inlet of the first compressor via a second lubricant passageway.

20. The method of claim 16, wherein the predetermined time period is between 1 second and 10 seconds.

* * * * *